US009396894B2

(12) United States Patent
Pora et al.

(10) Patent No.: US 9,396,894 B2
(45) Date of Patent: Jul. 19, 2016

(54) CONDUCTIVITY POWER CONNECTION

(71) Applicants: David P. Pora, Reigelsville, PA (US); Nathaniel J. Bower, Doylestown, PA (US); Alex J. Sinton, Doylestown, PA (US)

(72) Inventors: David P. Pora, Reigelsville, PA (US); Nathaniel J. Bower, Doylestown, PA (US); Alex J. Sinton, Doylestown, PA (US)

(73) Assignee: ROCAL CORPORATION, Warrington, PA (US)

( * ) Notice: Subject to any disclaimer, the term of this patent is extended or adjusted under 35 U.S.C. 154(b) by 174 days.

(21) Appl. No.: 14/071,590

(22) Filed: Nov. 4, 2013

(65) Prior Publication Data

US 2015/0122627 A1 May 7, 2015

(51) Int. Cl.

| | |
|---|---|
| ***H01H 19/08*** | (2006.01) |
| ***H01H 19/04*** | (2006.01) |
| ***H01H 19/14*** | (2006.01) |

(52) U.S. Cl.

CPC ..... *H01H 19/08* (2013.01); *H01H 19/04* (2013.01); *H01H 19/14* (2013.01); *H01H 2221/01* (2013.01); *H01H 2221/03* (2013.01); *H01H 2221/044* (2013.01); *H01H 2223/034* (2013.01)

(58) Field of Classification Search

CPC ..... H01H 19/08; H01H 19/04; H01R 24/28
USPC ..... 200/572, 565, 11 R, 600, 564, 536, 417, 200/341, 19.07
See application file for complete search history.

(56) References Cited

U.S. PATENT DOCUMENTS

| | | | | |
|---|---|---|---|---|
| 3,539,736 | A * | 11/1970 | Naimer | H01H 19/62 200/4 |
| 4,388,504 | A | 6/1983 | Hruda et al. | |
| 5,300,905 | A | 4/1994 | Kolbas et al. | |
| 5,316,319 | A * | 5/1994 | Suggs | F04D 29/102 251/214 |
| 5,454,724 | A | 10/1995 | Kloeppel et al. | |
| 5,562,490 | A | 10/1996 | Rybolt et al. | |
| 5,850,909 | A | 12/1998 | Wagner | |
| 5,864,106 | A | 1/1999 | Hartwig et al. | |
| 6,261,123 | B1 | 7/2001 | Kruger et al. | |
| 6,424,511 | B1 | 7/2002 | Levinas | |
| 7,767,916 | B2 * | 8/2010 | Kurihara | B60K 37/06 200/38 R |

* cited by examiner

*Primary Examiner* — Edwin A. Leon
*Assistant Examiner* — Iman Malakooti
(74) *Attorney, Agent, or Firm* — Cusick IP, PLLC; Clinton J. Cusick, Esq.

(57) ABSTRACT

An improved electrical switch that provides for manual connection and disconnect of power by hand by utilizing a compressible stack of elements to load force over a radial distance as rotated by a user of the switch to establish a high force, low resistance connection.

10 Claims, 15 Drawing Sheets

9/15

600
601
602
603
604
605
606
607
608
609
610
611
612
613
614
615
616
620
621
622
623
631
632
633
641
642
643
648
650
651
652
653
654
655
656
671
672
673
681
682
683

10/15
701
702
703
705
708
709
710
722
723
748
720
741
742
743
746
744
760
771
772
773
774
775
781
782
783
891
892
893
894
707
721
733
731
732
713
711
714
716
712
715
751
753
754
756
752
750
755

CONDUCTIVITY POWER CONNECTION

BACKGROUND OF THE INVENTION

1. Field of the Invention

The present general inventive concept is directed to an apparatus with manual operation and improved conductivity for temporarily disconnecting an electrical power source and providing for reconnection.

2. Description of the Related Art

Electrical connections are common in industrial applications and in automotive and trucking applications. Electrical power is used in a wide variety of electronic control devices as well in motor vehicles. Often, disconnection of electrical power is needed either to prevent electrical power loss from a battery, or to present a safe condition for a person to perform maintenance without the risk of electric shock, or prevent the operation of the system, such as an automotive engine starting. Also, a manual emergency disconnect is needed. In some cases, the electrical disconnection must be suited for locking such as in a lock-out tag-out or other regulatory requirement to insure that electrical power has been disconnected and cannot be inadvertently reconnected without proper authorization.

Known power disconnection devices include that disclosed in U.S. Pat. No. 4,388,504 to Hruda et al. which discloses a latching mechanism that utilizes hermetically sealed switch assembly and an air or hydraulic cylinder to apply sufficient force to open and close the switch. This pressure is used to provide an unlatching force to flip a conical washer provide switch contact movement. The washer is utilized to flip from convex upward to convex downward in order to maintain switch contact. A battery disconnect is provided in U.S. Pat. No. 5,562,490 which discloses a rotary switch with two contact arms that can be rotated to engage a contact and a conductor rod that can be inserted into the contact arms. A battery pack manual disconnect is provided by U.S. Pat. No. 6,261,123 to Kruger et al. This patent disclosed a turnable handle that must be raised and then turned to connect prongs to receptors to connect an electrical circuit. Other approaches include a pivotal cam lever in U.S. Pat. No. 5,823,808, while U.S. Pat. No. 5,850,909 utilizes a gear and rack to achieve a connection.

It has been found that increased force at a point of separable electrical contact reduces the resistance of the contact and provides increased performance. Experimental data regarding resistance across two pieces of copper bar was obtained with different force loads. Under 20 pounds of force, the resistance was measured at 344 micro ohms. Under 60 pounds of force, the resistance was measured at 240 micro ohms. Under 100 pounds of force, the resistance was measured at 205 micro ohms. Under 140 pounds of force, the resistance was measured at 194 micro ohms. Under 180 pounds of force, the resistance was measured at 185 micro ohms. Increased force reduces resistance and improves the performance of the connection. However, it is difficult to provide sufficient force by hand, and therefore it is difficult to provide a shutoff switch that provides increased performance while still being easy to operate by hand. What is needed is a power shutoff switch that can connect and disconnect an electrical power source by hand without the need for external forces or equipment and that provides high amounts of force in the established or reestablished contact to provide for low resistance and improved electrical performance of the severable electrical connection.

SUMMARY OF THE INVENTION

It is an aspect of the present invention to provide an electrical switch comprising a rotary handle and a lead screw attached to the rotary handle and configured to rotate with the handle. A compressible stack positioned within a recess of a seat that also retains a conductive element provides for gradual buildup of force to the conductive element as the lead screw is turned by a user to overcome a spring and contact a first post and a second post to establish a conductive connection and turn the switch on. The rotary handle can be turned in the opposite direction to disconnect the conductive connection and turn the switch off.

It is another aspect of the invention to provide an activation switch that is activated by a paddle disposed on the rotary handle so that the activation switch provides an activation signal when the conductive connection is made and does not provide an activation signal when the rotary handle begins to be turned by a user to disconnect the conductive connection.

It is another aspect of the invention to provide an inline connector suitable for use in alternating current, or three phase power applications. A male contact plate positioned within a male collar that is connected to a male back shell; the male contact plat can comprise up to three contacts suited for connection with up to three contacts positioned within a female contact plate positioned within a female collar; the male collar and female collar being threaded for threaded engagement so that rotational engagement of the female collar draws the female contact plate towards the male contact plate to force the male contacts against the female contact to create a high force, low resistance connection. An embodiment of the invention provides a compressible stack that allows for the high force, low resistance connection to be established over a longer distance so that it can be accomplished manually by a user. The above aspects can be obtained by the embodiments shown and described herein.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE INVENTION

Figure 1:
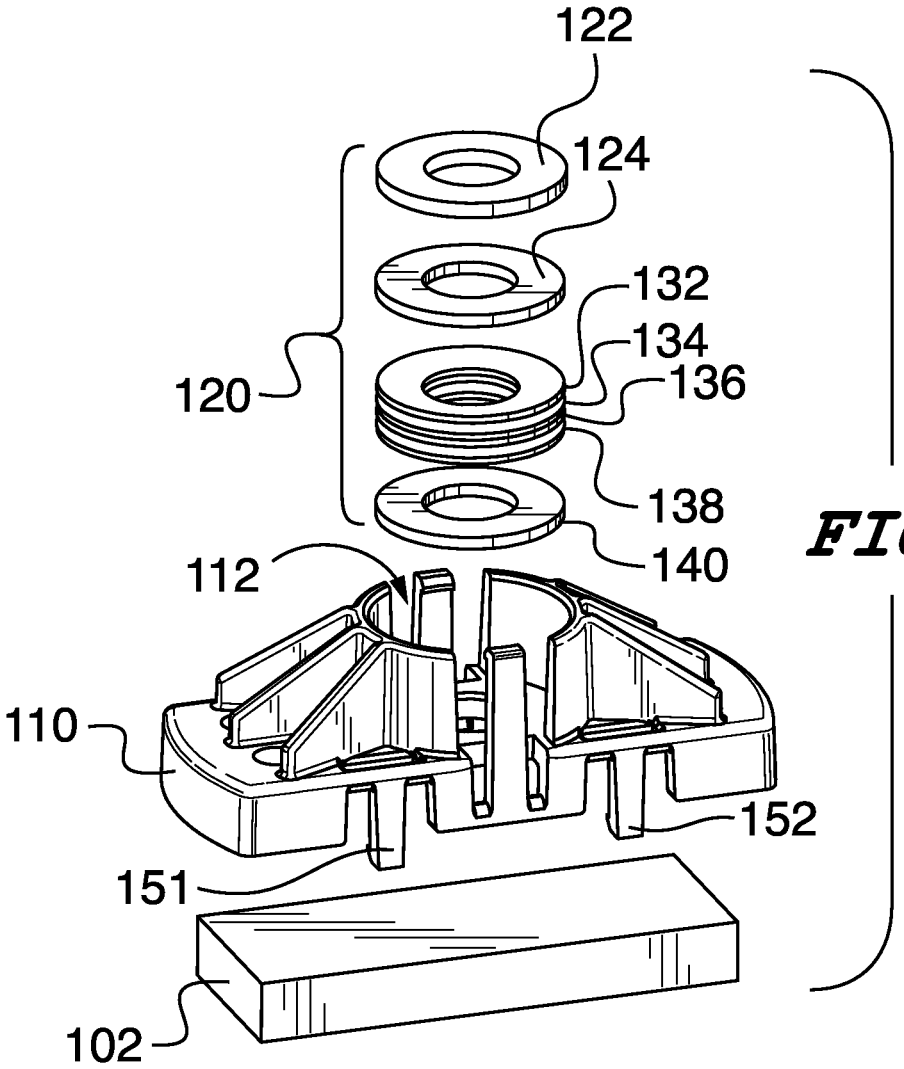
FIG. 1 presents an exploded view of a connection assembly in an embodiment of the invention

Reference will now be made in detail to the presently preferred embodiments of the invention, examples of which are illustrated in the accompanying drawings, wherein like reference numerals refer to like elements throughout.

The present inventive concept relates to a method and apparatus for providing an improved power shutoff switch. Provided herein is an improved means of establishing a high force connection for improved performance of an electrical connection suited for use in a shutoff switch or severable electrical connection. Provided also are embodiments of the inventive concept with practical applications.

Electrical connections between conducting elements can have increased performance when the elements forming the connection are maintained under force. For example, when two conductors are pressed together tightly, the resistance of the connection is lowered, and the performance of the connection is improved through increased current or amperage through the connection, decreased heating of the connection, and/or reduced voltage drop across the connection. Provided herein is a novel way to attain a high force electrical connection that can be connected and disconnected by hand and can provide an improved power shutoff switch.

FIG. 1 presents an exploded view of a connection assembly in an embodiment of the invention. Bus bar 102 can be positioned within seat 110 that provides for a short range of motion of bus bar 102 within seat 110. Any conducting element can provide the function of bus bar 102, but in the embodiment shown, the conducting element is a bus bar with sufficient length and width in a geometry that will not rock or shift within seat 110. This particular configuration is stable, and other configurations known in the art can also provide for electrical connection. Seat 110 can be made of an insulating material such as molded plastic. First seat tab 151 and second seat tab 152 are flexible and retain bus bar 102 within seat 110. Similar tabs, not shown, can be present on the opposing side of seat 110. Seat 110 is shown with recess 112 which can be cylindrical in shape and configured to receive a plurality of circular elements. In an embodiment, a number of elements can be combined to provide a high force connection such as compressible stack 120. Compressible stack 120 can be situated in recess 112 to retain the axial alignment of the elements comprising the stack. As few as one compressible element can make up a compressible stack. In this embodiment, four compressible elements, as well as other elements, comprise the compressible stack 120. Thrust washer 122 is positioned above first stack washer 124. Thrust washer 122 is of sufficient thickness to withstand contact forces. A suitable thrust washer 122 can have a thickness of 1/16" or nominally 0.063 inches thick. First stack washer 124 can be positioned adjacent thrust washer 122. At least one conical washer is employed to provide a high force connection. Conical washers appear to be concave on one side and convex on the other side and alternately can be referred to as "Belleville washers" or "spring washers". In the embodiment shown, four conical washers are employed. First conical washer 132 is oriented with the convex side towards second conical washer 134 which is positioned with the convex side upwards to contact first conical washer 132. A second pair of conical washers can be provided such as third conical washer 136 and fourth conical washer 138. These can be oriented with the convex sides facing each other. Second stack washer 140 can be positioned at the bottom of compressible stack 120. The conical washers 132, 134, 136, and 138 can be compressed to provide a gradual increase in force on seat 110 which in turn transfers the force to bus bar 102. The compression of an exemplar conical washer by 0.001 inches requires 10 pounds of force. The spring rate of an exemplar conical washer would be 10 pounds per thousandth of an inch. Variances in manufacture may result in a compression of 0.001 inches requiring between 8 and 12 pound of force representing a 20% variance. A series of four of these particular compressible washers therefore requires a force equivalent to 400 pounds to compress four compressible washers a total of 0.04 inches. Approximately 400 pounds will be understood to mean a range of 350 pounds to 450 pounds as the variances of materials and manufacture can lead to 10% to 20% variances in performance. For nominal compression of 0.04 inches, a 10% variance would provide at least 0.036 inches of compression in a compressible stack. Washers of all types are manufactured with some variability. A common tolerance for the thickness of washers in compressible stack 120 is plus or minus 0.002 inches each. Therefore the cumulative variance of the seven elements shown can be up to ±0.014 inches, which can introduce a force tolerance of ±140 pounds. Compensation for this variance is needed so that the switch provides the necessary force during connection despite variances in manufacture of the compressible elements such as, for example, thrust washer 122, first stack washer 124 or first conical washer 132. By pairing the conical washers in opposing directions, increased compression of compressible stack 120 is provided. First conical washer 132 is shown as convex side down whereas second conical washer is positioned with the convex side up. As a result, the circumference of first conical washer 132 is shown spaced apart from the circumference of second conical washer 132. Spacing of approximately 0.046 inches between a set of conical washers is reduced to 0.026 inches when first conical washer 132 is forced against second conical washer 134, as each conical washer compresses approximately 0.01 inches. In the embodiment shown in FIG. 1, the compressible stack 120 can be compressed a total of 0.040 inches. If the conical washers are oriented in the same direction, the spring rate will be increased, and the compression will occur across a shorter travel. If the conical washers are oriented in opposite directions, the spring travel will be increased and the compression will occur across a longer travel. In order to accommodate deviances or variances in manufacturing, and to provide an easier compression to accomplish for the user of the device of the invention, the conical washers can be positioned to increase spring travel as shown in FIG. 1. Second stack washer 140 transfers the force to seat 110 which retains bus bar 102 and moves bus bar 102 to contact other elements of the invention as shown in other figures. In an embodiment of the invention, bus bar 102 is rigid and transfers force without significant loss. A suitable material is copper. In an embodiment of the invention bus bar 102 can be made of copper and have a configuration of approximately 1.5 inches long, 0.5 inches wide and 0.25 inches high. Conical washers, such as first conical washer 132 can be made of material such as stainless steel. Other suitable materials include plastic, nickel, steel, phosphor bronze, Inconel, and other materials that provide a spring function when configured in a the shape of a conical washer.

Figure 2A:
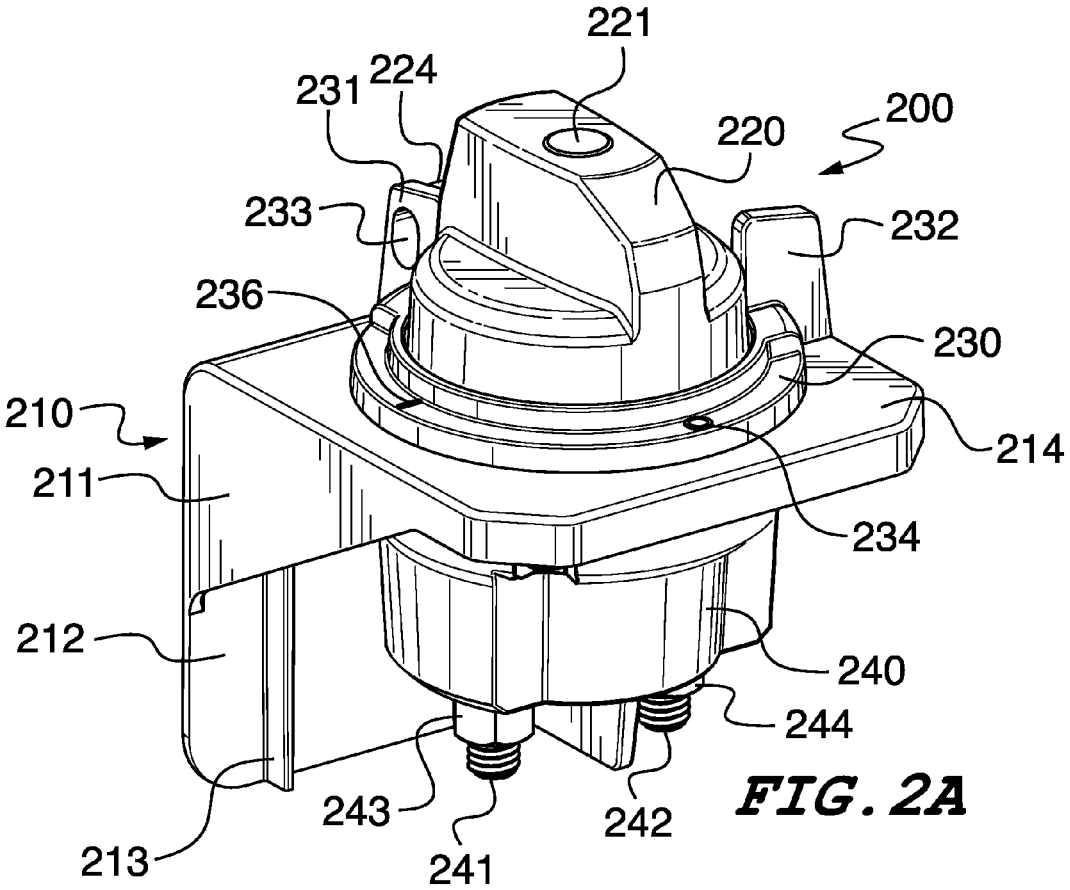
FIG. 2A presents a perspective view of a rotary switch assembly in an embodiment of the invention.

FIG. 2A presents a perspective view of a rotary switch assembly in an embodiment of the invention suited for use in applications with direct current (DC) power supply. Switch 200 can be mounted to a vehicle or other surface or device by mounting bracket 210. Mounting bracket can be reinforced by rib 213 or a side flange such as first side flange 211 in an embodiment. Bracket top 214 provides for retention of the components of the switch to mounting bracket 210. Bracket side 212 provides for attachment to a vehicle, device, or surface. Rotary handle 220 is positioned within bezel 230 which can include first stop 231 and second stop 232. Hole cover 221 is positioned at the top of rotary handle 220. Radial protrusion 224 projects from rotary handle 220 and is designed to engage first stop 231 or second stop 232 to limit the range of motion of rotary handle 220 such that radial protrusion 224 is maintained between first stop 231 and second stop 232. Bezel 230 can comprise open indicator 234 to indicate to a user when the rotary handle 220 is pointed to open indicator 234, the switch of the invention is open, and power through the switch is OFF. Bezel 230 can also comprise closed indicator 236 to indicate to a user that when the rotary handle is pointing towards closed indicator 236, the switch of the invention is closed and can supply current through the switch, i.e. the switch is in the ON position. First stop 231 comprises stop hole 233. Switch housing 240 is positioned below bracket top 214 and comprises first post 241 and first nut 243 as well as second post 242 and second nut 244.

Figure 2B:
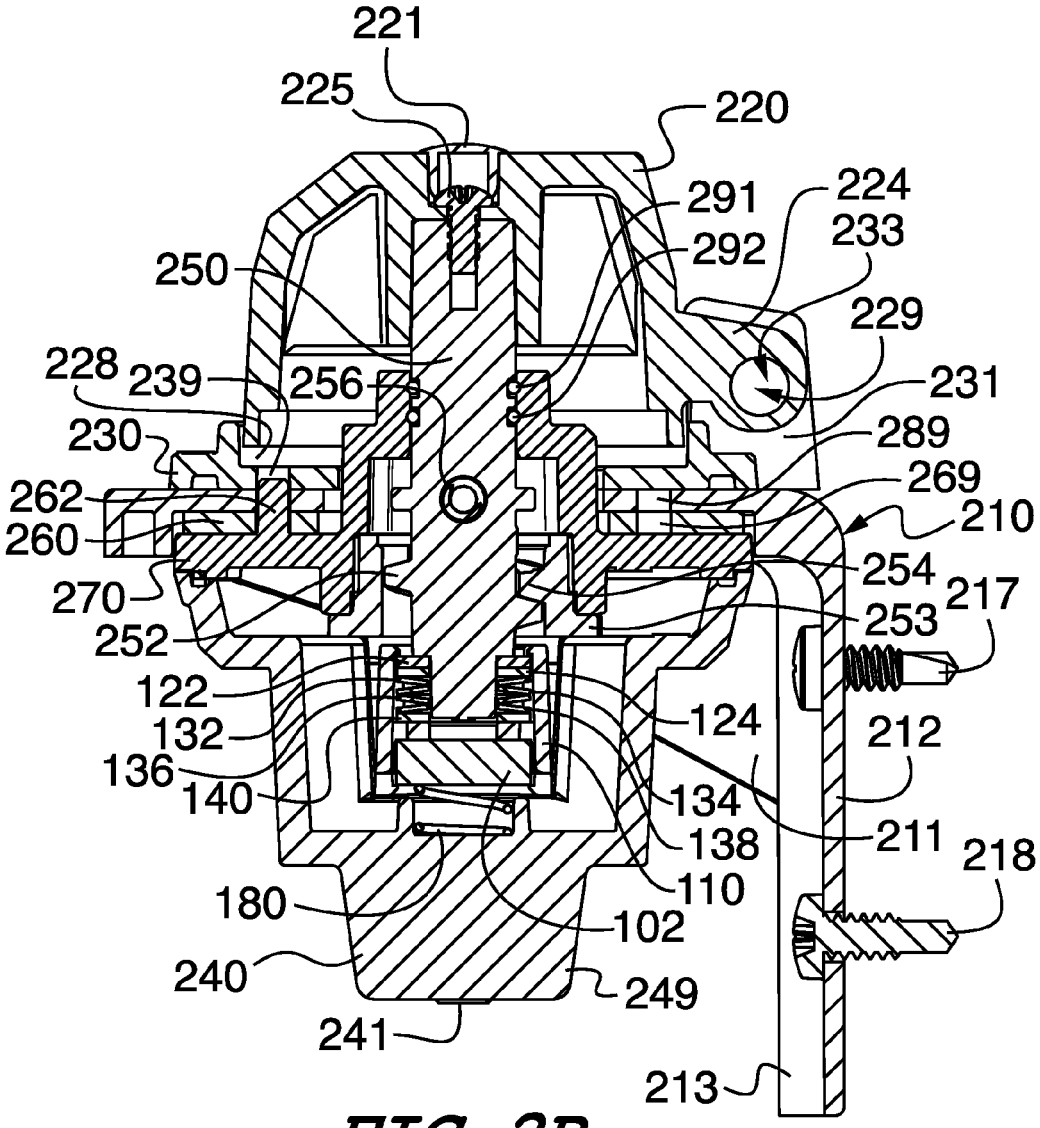
FIG. 2B presents a sectional view of a rotary switch assembly in an embodiment of the invention.

FIG. 2B presents a sectional view of a rotary switch assembly in an embodiment of the invention. First bracket fastener 217 and second bracket fastener 218 are shown disposed within bracket side 212 to provide for secure attachment of mounting bracket 210 to a vehicle, surface, or device. Fasteners suited for attachment as known in the art can be employed such as bolts, rivets, or the like to attach mounting bracket 210 to a vehicle, surface, or device. First stop 231 is shown adjacent radial protrusion 224 comprising protrusion hole 229. Protrusion hole 229 coincides with stop hole 233 in this view, and these combine to allow radial protrusion 224 to be attached or locked to first stop 231 with means such as a padlock (not shown) to prevent unauthorized movement of rotary handle 220 and effectively lock the device of the invention in a disconnected configuration. Handle fastener 225 is shown connecting rotary handle 220 to lead screw 250. When lead screw 250 is rotated, lead thread 252 engages fixed thread 254 disposed on lead nut 253 to push lead thread 252 upward or downward to move lead screw 250 upward or downward in concert. Lead thread 252 can be formed in a spiral on lead screw 250. Since lead screw 250 is fixedly attached to rotary handle 220 by way of handle fastener 225, rotary handle 220 will also move upward and downward within bezel 230 as it is rotated. Bezel gap 228 is shown between bezel 230 and rotary handle 220 and accommodates the movement of rotary handle 220 towards bezel 230. Lead nut 253 can be fixedly attached to assembly cap 270 by sonic welding or other means known in the art. Lead thread 252 can be configured in a pitch of 0.4 inches per revolution so that in the pictured embodiment, turning rotary handle 220 through a quarter turn will cause lead screw 250 to move 0.1 inches. Spring 180 provides a return force to move bus bar 102 upward when lead screw 250 is retracted and places the switch in a disconnected configuration. Switch locating key 262 intersects panel mount gasket 260, mounting bracket 210, and bezel 230, to establish alignment of these elements. First handle O-ring 291 and second handle O-ring 292 provide a seal between lead screw 250 and assembly cap 270. Detent spring 256 aids in the positioning of lead screw 250 in assembly cap 270.

Figure 2C:
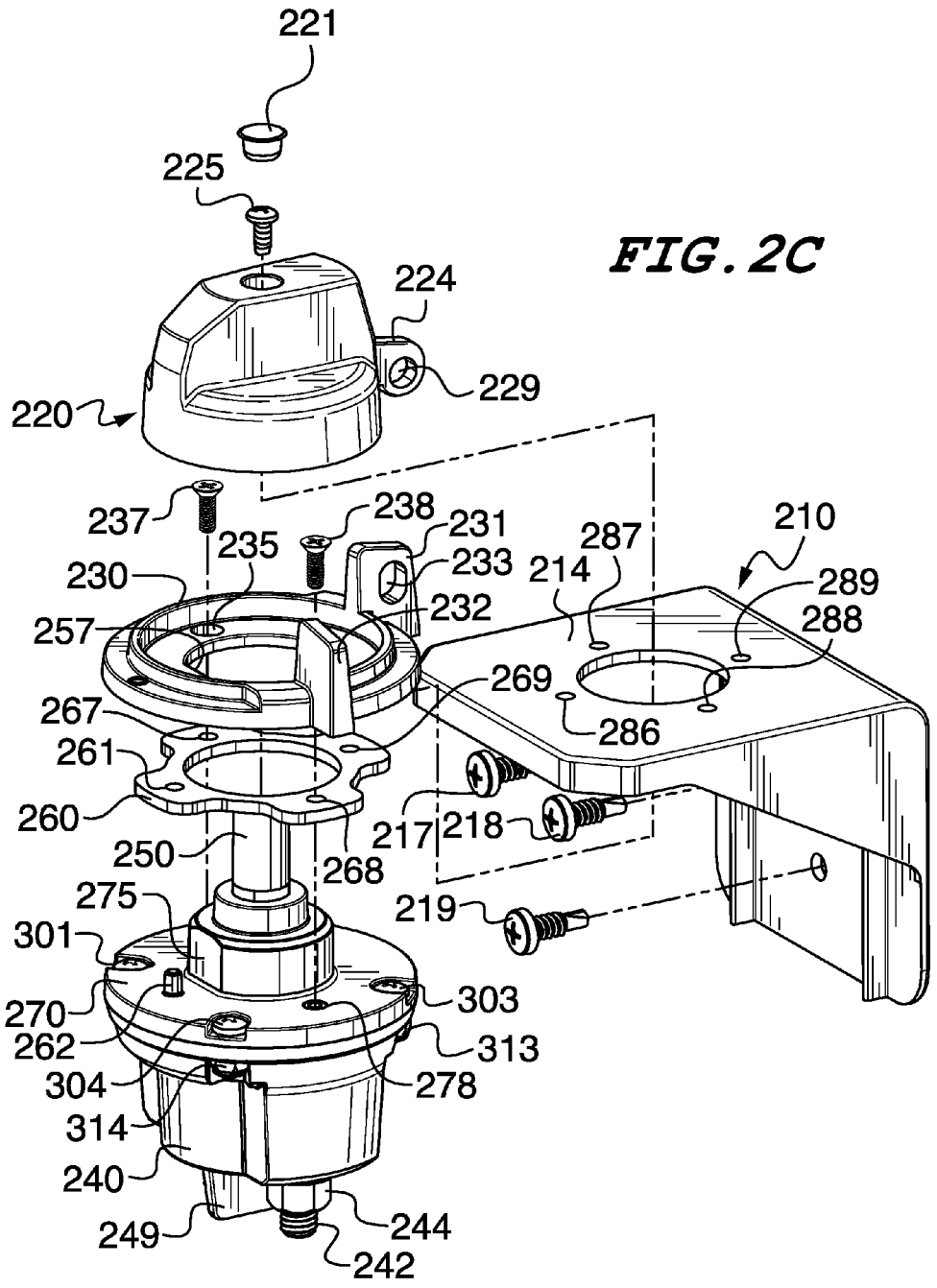
FIG. 2C presents a partially exploded view of a rotary switch assembly in an embodiment of the invention.

FIG. 2C presents a partially exploded view of a rotary switch assembly in an embodiment of the invention. Assembly cap 270 can be attached to switch housing 240 by conventional means such as fourth cap fastener 304 and fourth cap nut 314 and third cap fastener 303 and third cap nut 313 to maintain the connection of assembly cap 270 to switch housing 240. First cap fastener 301 engages first cap nut 311, not shown, to retain assembly cap 270 to switch housing 240. Assembly cap 270 comprises locating flat 275 configured to engage bezel flat 257, and maintain the rotational alignment of bezel 230 relative to assembly cap 270. First bezel screw 237 can pass through bezel first opening 235, bracket first opening 287, and gasket first opening 267 to engage assembly cap 270 in a cap first opening, not shown. Second bezel screw 238 can pass through bezel second opening (not shown), bracket second opening 288, and gasket second opening 268 to threadedly engage cap second opening 278 to secure attachment of bezel 230, assembly cap 270, and panel mount gasket 260 to mounting bracket 210. Gasket third opening 261 and gasket fourth opening 269 are disposed on panel gasket 260. Rotary handle 220 is secured to lead screw 250 by handle fastener 225. Mounting bracket 210 contains first alternate opening 286 and second alternate opening 289, so that the other elements of the embodiment can be mounted in different configurations, namely rotated 90, 180, or 270 degrees from the orientation shown in FIGS. 2A through 2D as desired in various applications. Second side flange 215 provides added stability.

Figure 2D:
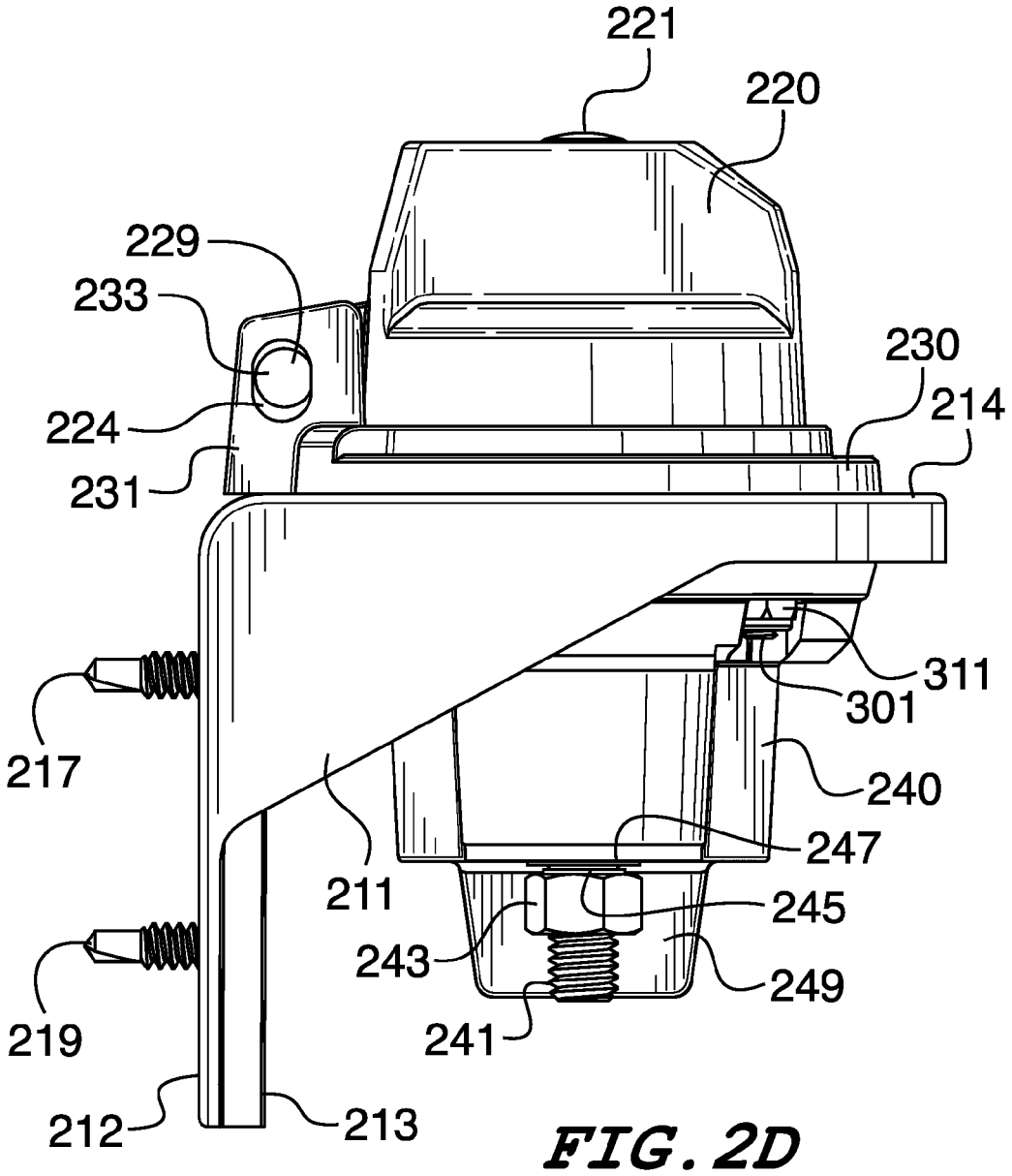
FIG. 2D presents a side view of a rotary switch assembly in an embodiment of the invention.

FIG. 2D presents a side view of a rotary switch assembly in an embodiment of the invention. Radial protrusion 224 is shown behind first stop 231. Protrusion hole 229 overlaps stop hole 233 and enables the rotary handle to be locked by means such as a padlock, not shown. Bezel 230 is shown adjacent bracket top 214. Flange 249 is shown behind first post 241 and provides physical separation of first post 241 and second post 242, not shown, for safety and convenience. First cap fastener 301 is shown engaged with first cap nut 311 to attach assembly cap 270, not shown, to switch housing 240. First cap fastener 301 passes through cap first opening, not shown.

Figure 3:
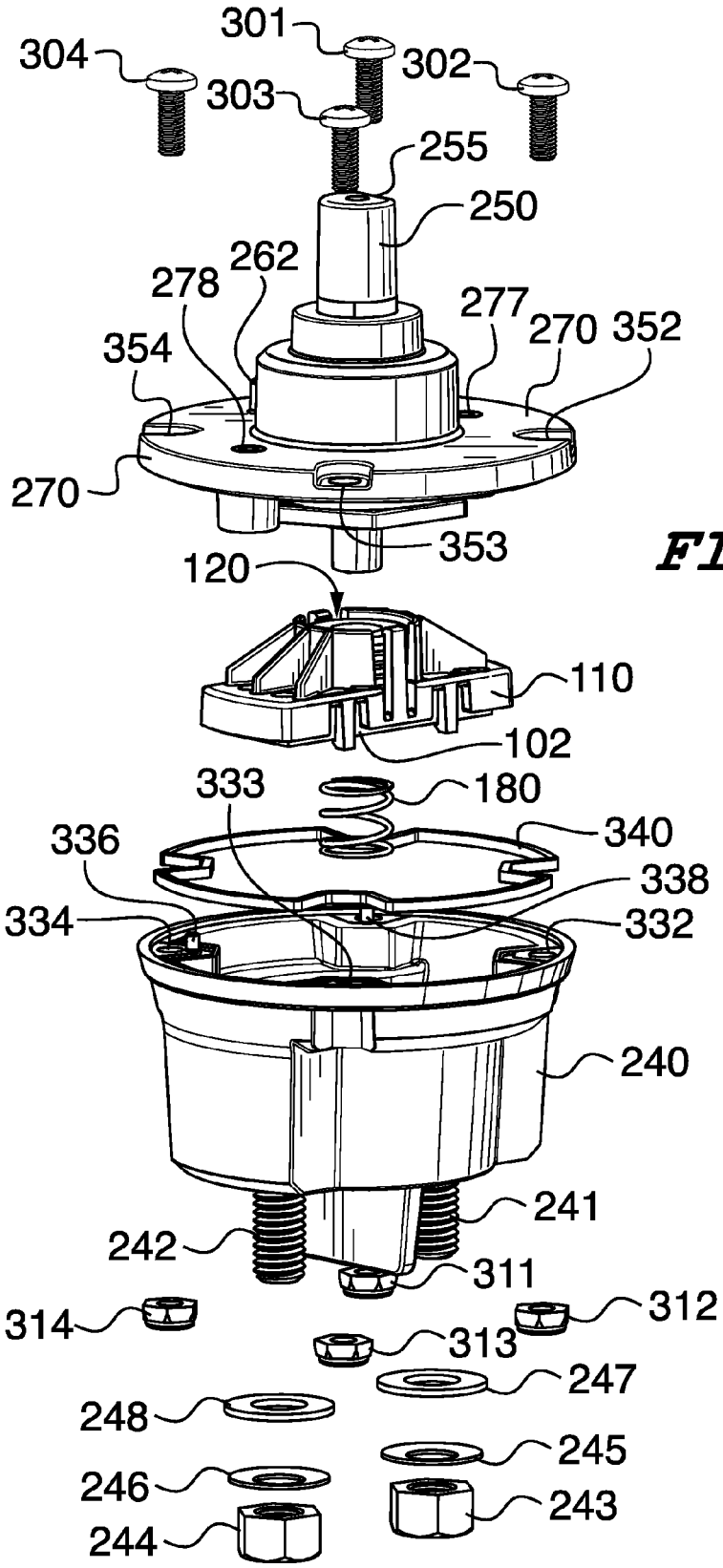
FIG. 3 presents an exploded view of the switch sub assembly of an embodiment of the invention.

FIG. 3 presents an exploded view of a switch subassembly, comprising switch housing 240 and some elements connected to switch housing 240, in an embodiment of the invention.

Cap fasteners 301, 302, 303, and 304 attach assembly cap 270 to switch housing 240. Second cap fastener 302 passes through cap second opening 352 and housing second opening 332 to engage second cap nut 312. Third cap fastener 303 can pass through cap third opening 353 and housing third opening 333 to engage third cap nut 313 in similar fashion. Cap fasteners 301 and 304 can be connected in similar fashion as shown in FIG. 3. Cap fourth opening 354 can have an irregular circumference to accommodate first locating boss 336. Similarly, cap first opening, not shown, can have an irregular circumference to accommodate second locating boss 338. Lead screw 250 is shown with shaft flat side 255 which can engage a similarly shaped opening in rotary handle 220, not shown, to prevent slippage of lead screw 250 relative to rotary handle 220, not shown. Cap first opening 277 can receive first bezel screw 237, not shown. Cap second opening 278 can receive second bezel screw 238, not shown. Housing gasket 340 is positioned between switch housing 240 and assembly cap 270 to provide a seal. First post 241 is suited for threaded attachment to complete a circuit or establish an electrical contact or connection as needed. Second post 242 is similarly suited for threaded attachment to complete an electrical connection as needed. First washer 247, first conical washer 245, and first nut 243 connect to first post 241 and can be used to establish a connection as needed. Electrical contact or connection can be established to second post 242 with second washer 248, second conical washer 246, and second nut 244 to make a secure connection as needed.

As shown and described in the preceding FIGS. 1 through 3, a user can turn rotary handle 220 which in turn rotates lead screw 250. Lead thread 252 is guided by fixed thread 254. Upon clockwise rotation, lead screw 250 is forced toward compressible stack 120 to compress compressible stack 120 and force bus bar 102 to overcome spring 180 and provide a high force contact of bus bar 102 to first post 241 and second post 242. In this way, a high force, high conductivity connection is made, and when first post 241 and second post 242 are connected to a power source or circuit, the conductive element or bus bar 102 connects the power source with a high force, low resistance connection. In the embodiment shown in the preceding figures, clockwise rotation of the rotary handle 220 will force bus bar 102 to contact first post 241 and second post 242. Rotation counterclockwise removes the force on compressible stack 120 and allows spring 180 to move bus bar 102 away from posts 241 and 242, and, in this configuration, the switch is open or disconnected. Radial protrusion 224 is configured to be locked to first stop 231 to lock the device of the invention in the disconnected configuration. Alternately lead screw 250 can be configured to operate in the reverse by reversing the slope of lead thread 252 so that counterclockwise rotation effects compression and connection of the device. Rotation of rotary handle 220 in a first direction will have the opposite effect on the lead screw as rotation of rotary handle 220 in an opposite, second direction. A first direction could be clockwise, and a second direction could be counterclockwise. The reverse could also be accomplished in the spirit of the invention. The pitch of lead thread 252 can be altered to increase or decrease the compression of compressible stack 120 for a given amount of rotation of rotary handle 220. The position of second stop 232 can be altered to provide more or less range of motion of rotary handle 220.

While the use of a compressible stack in an embodiment of the invention provides a high force, high conductivity connection with advantages including low resistance and low power loss, the action of the connection can be relatively slow as a user turns a rotary handle. The use of compressible washers provides the development of the force over a longer distance, and allows the force to be generated manually with a modest amount of hand strength being required by the user of the switch. This advantage allows the switch to be operated by hand and easily connects or disconnects a circuit or a power source. One potential drawback of the preceding embodiment is that it may allow for arcing between the posts and the bus bar as the distance is increased or decreased. This is especially true in high voltage applications. Arcing creates high temperatures that can create material transfer between the elements of the device, pitting, deterioration of the bus bar and posts, and result in degraded performance.

It is a further aspect of the invention to provide an activation relay that can be used in conjunction with another switch to either delay the supply of voltage or emf until the contacts of the invention are in physical contact; or to remove the supply of voltage or emf before the contacts have physically separated. Herein, the device is closed when the posts are connected via a conductive element. The device is open when a conductive element such as bus bar 102 is spaced apart from first post 241 and second post 242. An activation switch can provide for delay of power supply to the switch until the switch is sufficiently closed. In this way, arcing can be avoided. An activation switch can also remove power from the switch as the switch begins to be activated by a user, as the rotary handle begins to be turned towards an open configuration.

Figure 4A:
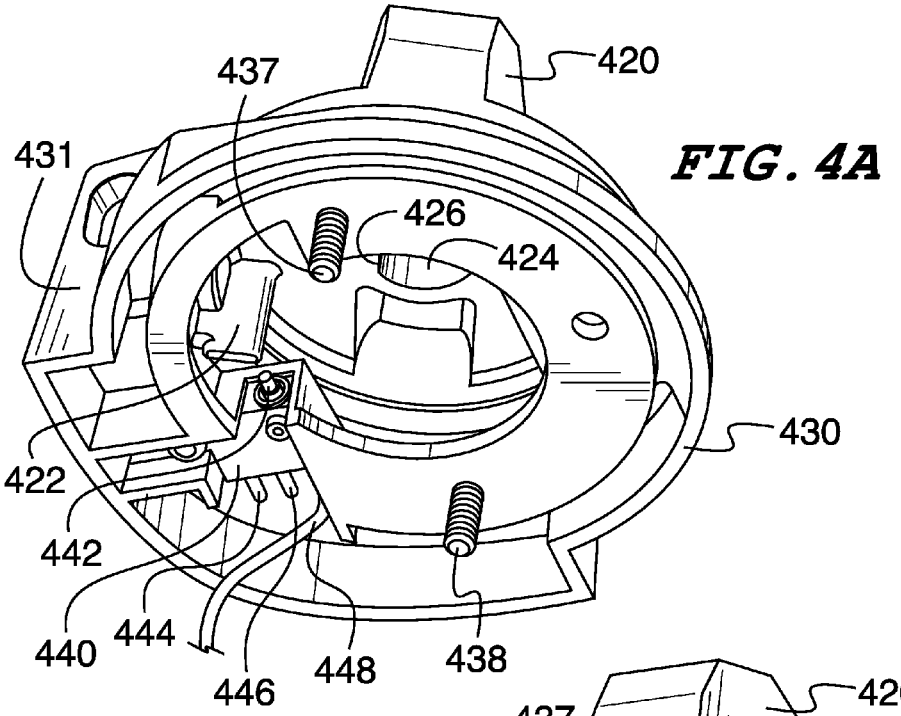
FIG. 4A presents a perspective view of a rotary handle comprising an activation switch in an embodiment of the invention.

FIG. 4A presents a perspective view of a rotary handle further comprising an activation switch in an embodiment of the invention. Rotary handle 420 further comprises paddle 422 which moves in concert with the rotation of rotary handle 420. Activation switch 440 is connected to first lead wire 444 and second lead wire 446 and signal wire 448. Activation switch 440 can be a Micro Switch™ made by Honeywell or a snap-action switch as is known in the art. Electricity or an electrical signal can be provided to activation switch 440 by first lead wire 444. When activation switch 440 is open, the signal or electricity is provided to second lead wire 446. When activation switch is closed by depressing plunger 442, the signal or electricity is provided to signal wire 448 to provide an activation signal. Plunger 442 can be activated by paddle 422. Upon turning of rotary handle 420 away from first stop 431, paddle 422 is turned to engage and depress plunger 442. This movement completes a circuit in activation switch 440 and provides a signal to signal wire 448. First bezel screw 437 and second bezel screw 438 can attach bezel 430 to an assembly cap such as that shown in FIG. 2C. Handle recess 424 is configured to receive a lead screw such as lead screw 250 of FIG. 3 comprising a shaft flat side 255 to interface with handle flat 426 to prevent slippage of rotary handle 420 relative to lead screw 250 of FIG. 3.

Figure 4B:
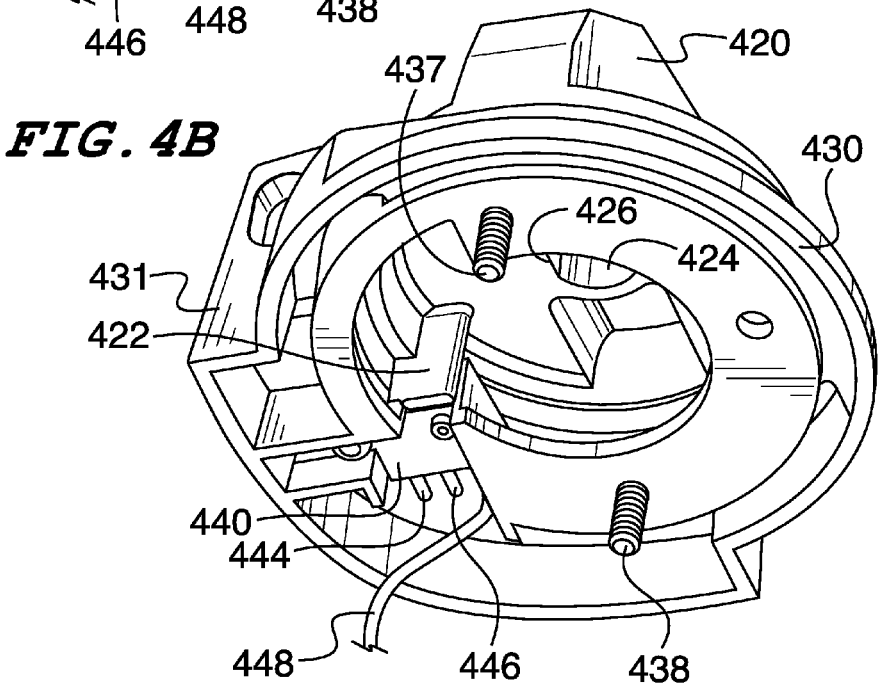
FIG. 4B presents a perspective view of a rotary handle comprising an activation switch in an embodiment of the invention.

FIG. 4B presents a perspective view of a rotary handle further comprising an activation switch in an embodiment of the invention. Paddle 422 is shown as contacting and depressing plunger 442, not show, to complete a circuit within activation switch 440 and provide an activation signal through signal wire 448. In an application of the invention, voltage available to the switch of the invention can be suspended until activation switch 440 provides the activation signal to signal wire 448. In this way, arcing can be prevented during the turning of rotary handle 420 in an embodiment of the invention. The signal wire 448 can be connected to a solenoid or electronic controller not shown. The solenoid or electronic controller, not shown, can delay the delivery of power through the switch so that the electrical connections of the bus bar are at least partially made prior to making voltage available to the switch of the invention and can remove power prior to the electrical connections separating by removing power in the absence of the activation signal through signal wire 448. A solenoid or electronic controller that provides voltage when plunger 442 is depressed and withholds voltage when plunger 442 is not depressed—will prevent arcing as voltage is not present when there is a physical gap or spacing between a bus bar and first post and second post as shown in FIG. 2B where the bus bar 102 is up and the switch is open. A controller or solenoid that provides voltage to the switch only upon receipt of an activation signal from signal wire 448, will prevent arcing from partial or slow electrical connection made by the turning of the switch of the invention.

Figure 4C:
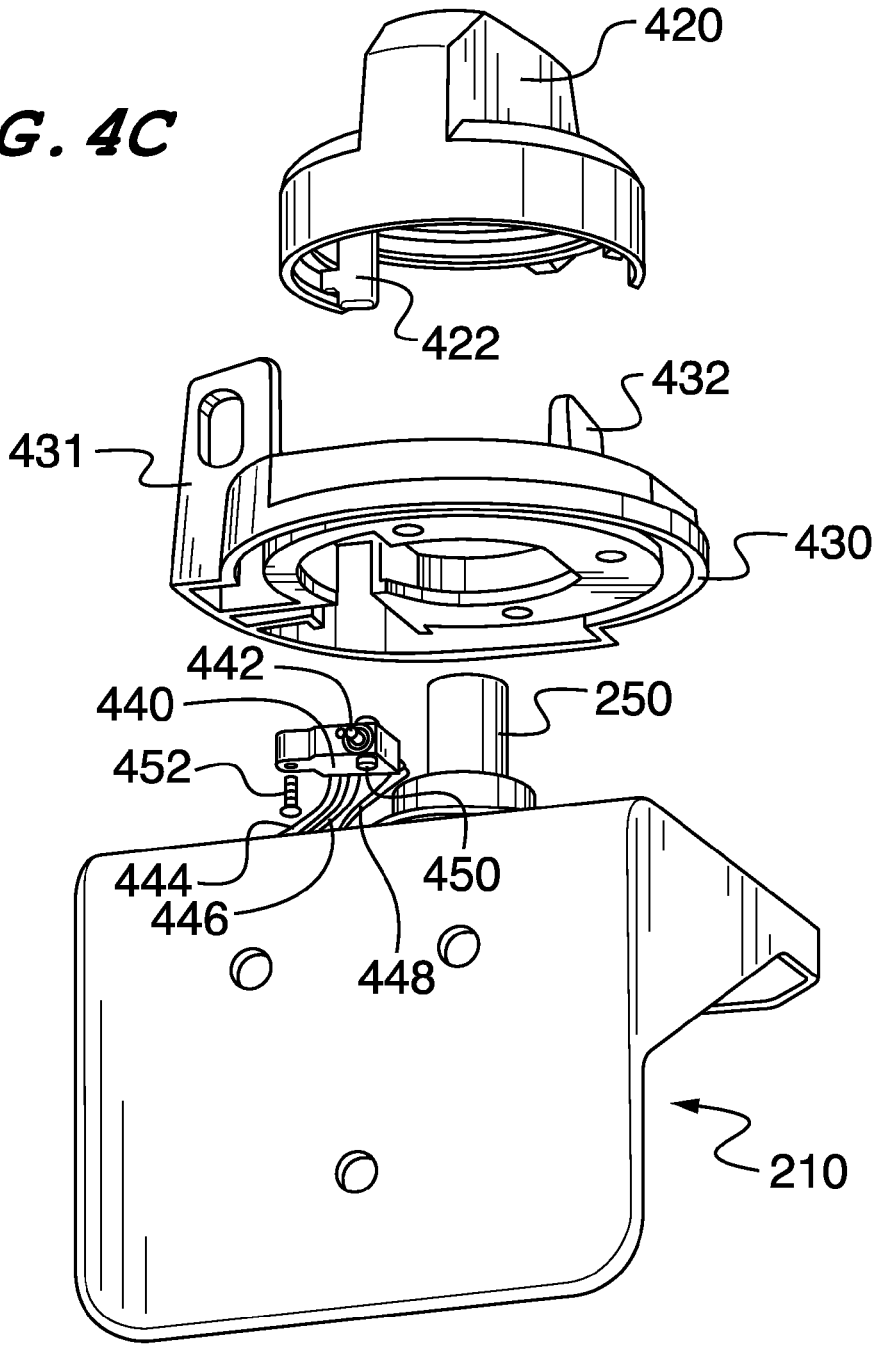
FIG. 4C presents a partially exploded view of a rotary switch in an embodiment of the invention comprising an activation switch.

FIG. 4C presents a partially exploded view of rotary switch in an embodiment of the invention comprising an activation switch. Rotary handle 420 comprises paddle 422. Paddle 422 can turn in concert with rotary handle 420. Bezel 430 is shown comprising first stop 431 and second stop 432. Activation switch 440 can be attached to bezel 430 with a first fastener 450 and a second fastener 452. Signal wire 448 can be connected to a solenoid or electrical controller as is known in the art. Rotation of rotary handle 420 causes paddle 422 to depress plunger 442 and close a circuit in activation switch 440 and cause a signal to be sent to signal wire 448. Other activation switches known in the art can be employed wherein the plunger is replaced with a toggle, rocker switch, or other means of activating an on-off switch to create an activation signal.

Another embodiment of the invention can be provided to facilitate inline electrical connections. It is desirable to provide high efficiency, low resistance separable connections in the form of a plug or inline connector. Applications include providing a high performance separable connection for use in A/C circuits comprising positive, neutral, and ground wires. Additional applications include three phase electrical supply requiring a connection of three separate conduits. In applications utilizing alternating current in 110 volts, wiring typically includes three wires known as hot, neutral, and ground. In applications utilizing alternating current at 220 volts, wiring typically included three wires known as hot, hot, and ground. Three phase power includes three wires that supply power 120 degrees out of phase and typically includes three wires, one to carry each of the x, y, and z phases. The following figures detail an improved electrical connection utilizing three contacts that provides a high force, low resistance connection that can be connected and disconnected by hand.

Figures 5A, 5B, 5C:
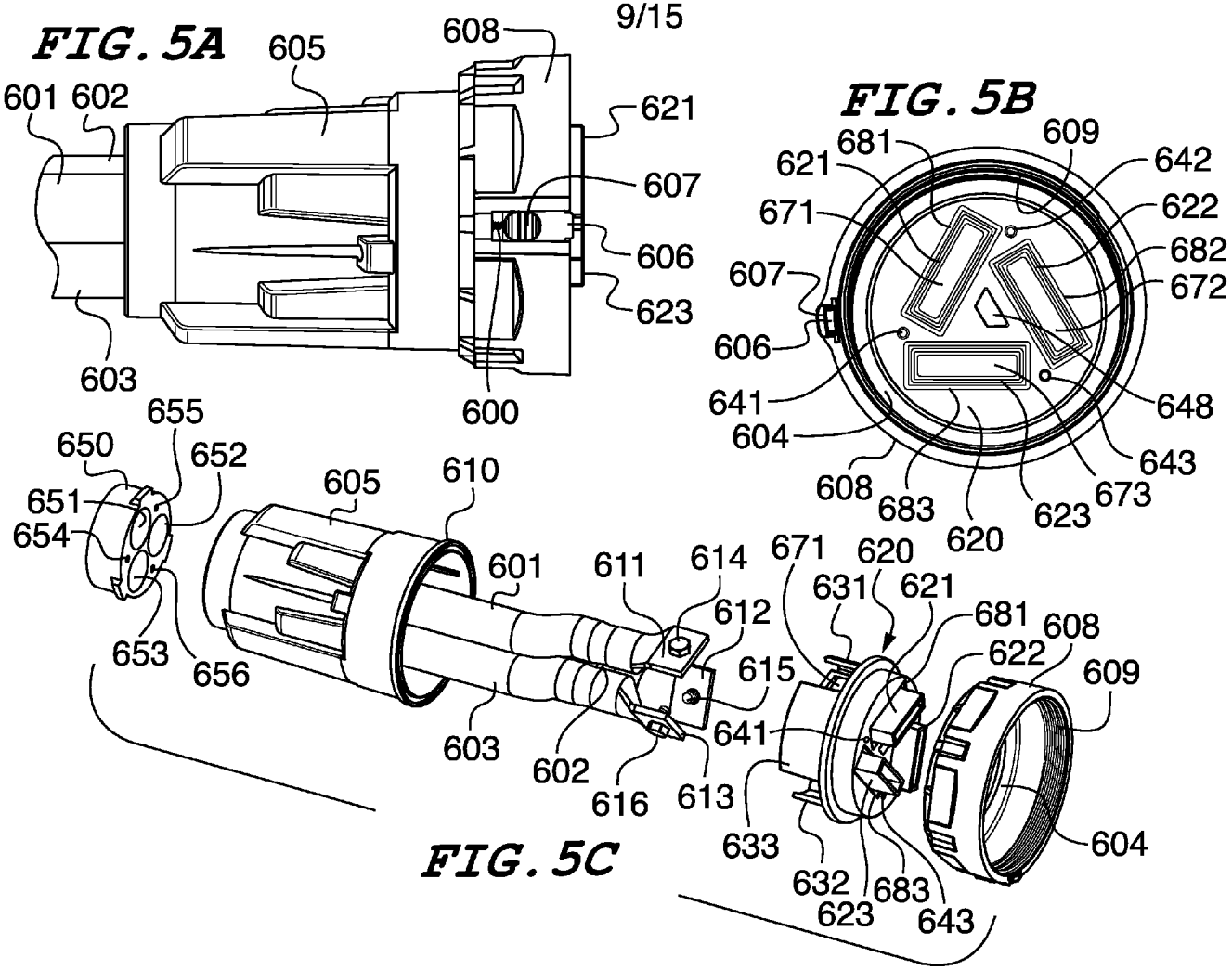
FIG. 5A presents a side view of a female side of an in-line connector in an embodiment of the invention.
FIG. 5B presents an axial view of a female side of an in-line connector in an embodiment of the invention.
FIG. 5C presents an exploded view of a female side of an in-line connector in an embodiment of the invention.

FIG. 5A presents a side view of a female side of an inline connector in an embodiment of the invention. The embodiment provides a high efficiency electrical connection that is established and disconnected by hand and provides a high force, low resistance connection. First female conduit 601, second female conduit 602, and third female conduit 603 enter female back shell 605. Female collar 608 is rotatable about female back shell 605. First female finger guard 621 and third female finger guard 623 are shown protruding past female collar 608. Tab button 607 is disposed on locking tab 606. Tab button 607 can be depressed and moved inward to retract locking tab 606. Spring 600 biases locking tab 606 outward.

FIG. 5B presents an axial view of a female side of an inline connector in an embodiment of the invention. Female contact plate 620 is shown axially centered within female collar 608. First female contact 671 is shown inside first female finger guard 621. First female gap 681 surrounds first female finger guard 621 and provides for passage of other elements of the embodiment into the interior of female contact plate 620. Second female contact 672 is shown inside second female finger guard 622. Second female gap 682 surrounds second female finger guard 622. Third female contact 673 is shown inside third female finger guard 623. Third female gap 683 surrounds third female finger guard 623. Interior threads 609 are disposed on the interior of female collar 608. First female contact 671 is a conductor and is preferably made of a conductive metal. Copper is a suitable material known for high conductivity, and first female contact 671, second female contact 672, and third female contact 673 can be made of copper. Female back shell 605, female collar 608, and contact plate 620 are preferably made of non-conducting material such as molded plastic or other suitable materials. First female conduit 601, second female conduit 602, and third female conduit 603 are preferably composed of a conducting material surrounded by an insulating material. Plastic coated copper wire or other common conductors and insulators known in the art can be employed. First auxiliary socket 641 is disposed within female contact plate 620. In some applications it is desirable to conduct a signal along with the transmission of current or voltage. Second auxiliary socket 642 and third auxiliary socket 643 are disposed within female contact plate 620 and the three auxiliary sockets can be utilized to carry a signal to communicate information such as the temperature of a power generator, or other information known in the art. Alignment recess 648 is disposed within female contact plate 620 and can be D-shaped or trapezoidal in cross section to facilitate orientation of the contacts shown.

FIG. 5C presents an exploded view of a female side of an inline connector in an embodiment of the invention. First female conduit 601, second female conduit 602, and third female conduit 603 can pass through female grommet 650 via female grommet first guide 651, female grommet second guide 652, and female grommet third guide 653, to provide stability and seal the elements of the device. Grommet 650 fits within female back shell 605. First female conduit 601 can be connected to female first tab 611, and female first lug 614 can be threadedly connected to female first tab 611. Second female conduit 602 can be connected to female second tab 612 configured to threadedly receive female second lug 615. Third female conduit 603 can be connected to female third tab 613 which can be threadedly connected to female third lug 616. Skirt first section 631 is configured to engage female back shell 605. The gap between skirt first section 631 and skirt third section 633, for example, allows access to female first lug 614 so that it can be rotated as needed to connect female first tab 611 to first female contact 671. Skirt second section 632 is shown spaced apart from skirt third section 633. First female auxiliary guide 654, second female auxiliary guide 655, and third female auxiliary guide 656 are disposed in female grommet 650 to allow passage of auxiliary signal wires, not shown, as needed. In assembly, female collar 608 can slide over female back shell 605 from the left side of the figure, and female collar stop 604 engages retainer 610 to prevent further movement. Female collar 608 is rotatable against retainer 610 and thus female collar 608 is rotatable about female back shell 605. Female contact plate 620 can be removably connected to female back shell 605 with conventional threaded fasteners, such as screws, not shown, to prevent rotation of female contact plate 620 relative to female back shell 605.

Figure 5D:
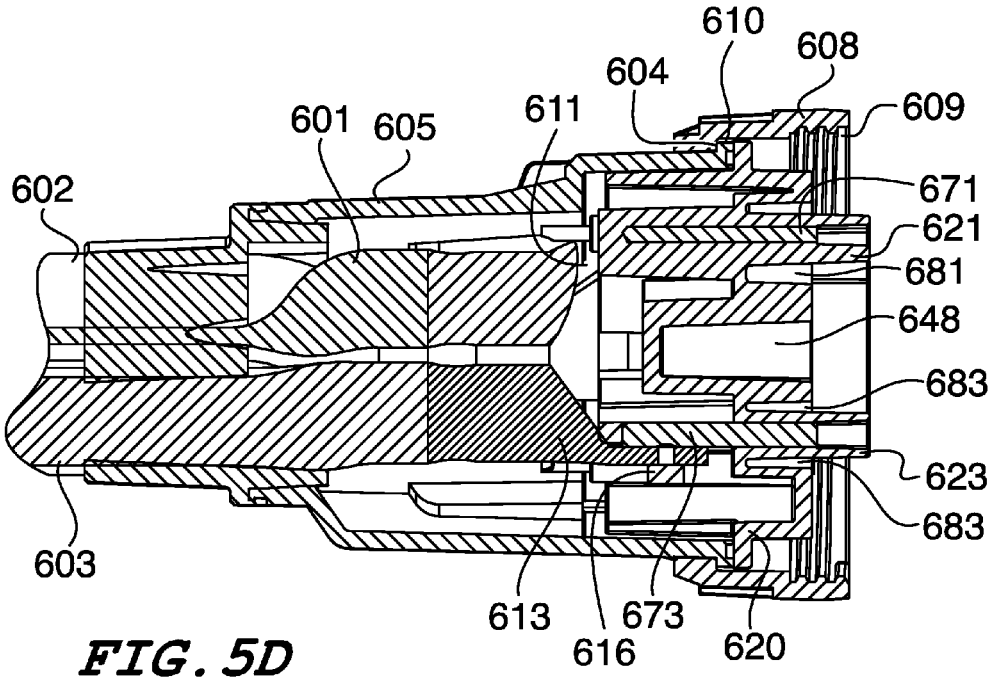
FIG. 5D presents a sectional view of a female side of an in-line connector in an embodiment of the invention.

FIG. 5D presents a sectional view of a female side of an inline connector in an embodiment of the invention. Third female conduit 603 is show terminating in female third tab 613 which is threadedly connected to third female contact 673 positioned within third female finger guard 623. Third female gap 683 is shown exterior to third female finger guard 623. First female contact 671 is shown within first female finger guard 621 which is surrounded by first female gap 681.

Figures 6A, 6B, 6C:
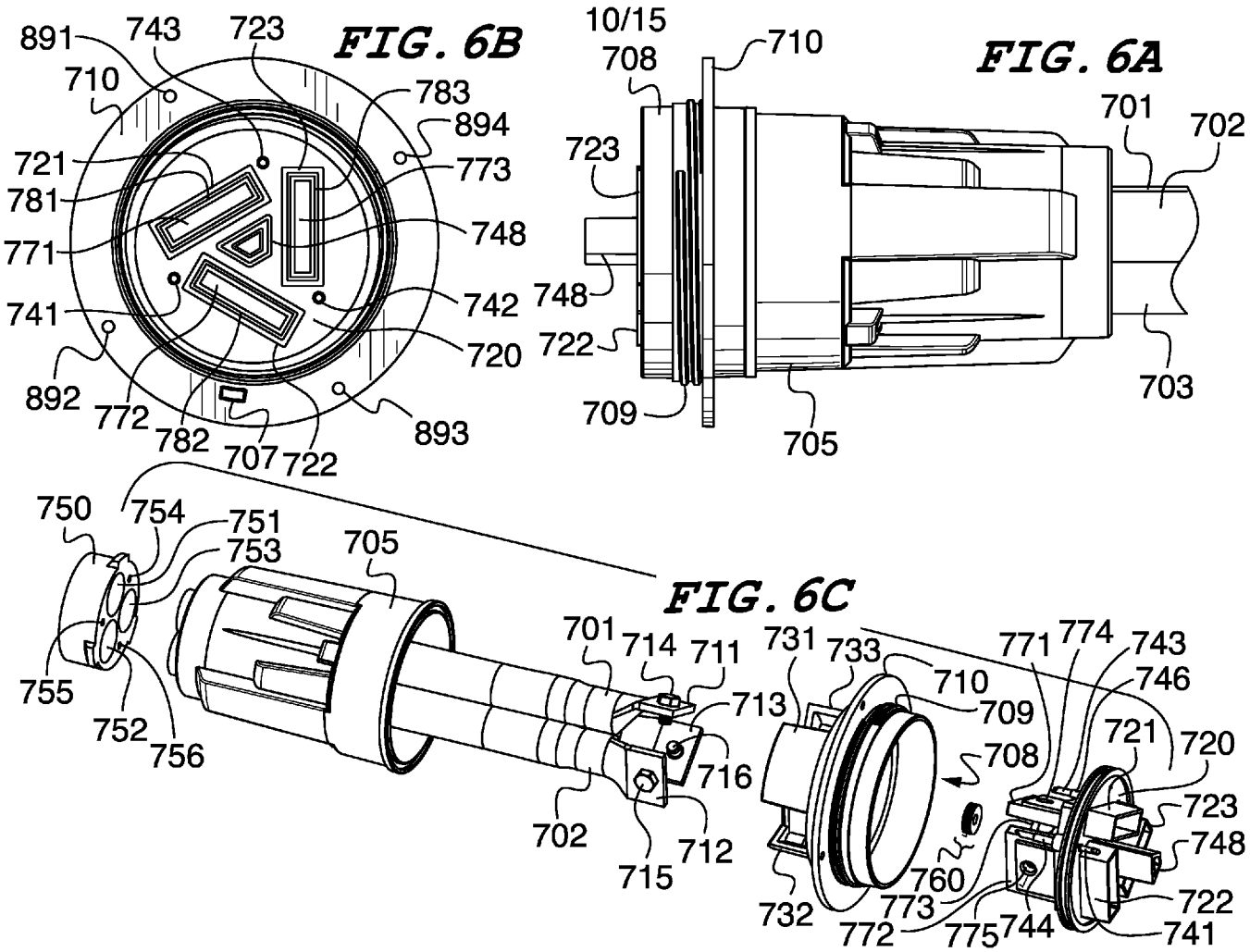
FIG. 6A presents a side view of a male side of an in-line connector in an embodiment of the invention.
FIG. 6B presents an axial view of a male side of an in-line connector in an embodiment of the invention.
FIG. 6C presents an exploded view of a male side of an in-line connector in an embodiment of the invention.

FIG. 6A presents a side view of a male side of an inline connector in an embodiment of the invention. Male collar 708 is configured with exterior threads 709 and flange 710. First male conduit 701, second male conduit 702, and third male conduit 703 can be conventional electrical conduits comprising a conductor such as copper wire inside of plastic insulation to prevent conductivity between the conduits. Male back shell 705 is substantially hollow to allow the passage of conduits 701, 702, and 703. Alignment key 748 is configured to interface with alignment recess 648 of FIG. 5B to ensure rotational alignment of male side and female side of the inline connector. Second male finger guard 722 is shown with third male finger guard 723.

FIG. 6B presents an axial view of a male side of an inline connector in an embodiment of the invention. Male contact plate 720 is shown axially centered within male collar 708. Alignment key 748 can be D shaped or trapezoidal and configured to interface with alignment recess 648 of FIG. 5B. Locking slot 707 is disposed within the surface of flange 710 and is suited to receive locking tab 606 as shown in FIG. 5A. Male contact plate 720 comprises first male finger guard 721, second male finger guard 722, and third male finger guard 723. First auxiliary pin 741, second auxiliary pin 742, and third auxiliary pin 743 protrude from male contact plate 720 and can carry an auxiliary signal as needed in various applications. First male contact 771 is shown inside of first male finger guard 721. Second male contact 772 is shown inside second male finger guard 722. Third male contact 773 is shown inside third male finger guard 723. First male gap 781 surrounds first male contact 771 and is configured to receive first female finger guard 621 shown in FIG. 5C. Similarly, first male finger guard 721 is configured to be inserted into first female gap 681, as shown in FIG. 5B. In this way, the male and female finger guards can be telescoped so that first male contact 771 can contact first female contact 671 shown in FIG. 5B. Second male gap 782 surrounds second male contact 772 and is configured to receive second female finger guard 622 as shown in FIG. 5C. Similarly, third male gap 783 surround third male contact 773 and is configured to receive third female finger guard 623. Panel mount holes 891, 892, 893, and 894 are present in flange 710 and allow the male side of the inline connector to be wall mounted or panel mounted, as it may be convenient to have one side of the invention held in a fixed location, and this allows the male side to function similar to a wall outlet.

FIG. 6C presents an exploded view of a male side of an inline connector in an embodiment of the invention. Male contact plate 720 comprises first auxiliary pin 741 which can be used for carrying an auxiliary signal through the device of the invention and is shown traversing male contact plate 720 and protruding from first shroud 744. Third auxiliary pin 743 is shown protruding from third shroud 746. First male finger guard 721 can be rectangular in shape, and made of molded plastic or other non-conductive material. Second male finger guard 722 and third male finger guard 723 can also be made of molded plastic or other non-conductive material and prevent a user from touching an electrical conductor such as first male contact 771. The finger guards especially prevent a user from touching two electrical conductors and completing a circuit which can be harmful or fatal. First male contact 771 is shown projecting inward from male contact plate 720. First male contact 771 has first threaded opening 774 configured to connect to male first tab 711 by threaded connection with male first lug 714. Second male contact 772 is shown with second threaded opening 775 configured to connect second male contact 772 to male second tab 712 by threaded connection with male second lug 715. Male second lug 715 first passes through male second tab 712 and then engages second threaded opening 775 in second male contact 771. Third male contact 773 is configured for connection to male third tab 713 by threaded connection with male third lug 716 via third threaded opening, not shown. Male contact plate 720 is slidable within the interior of male collar 708. Compressible stack 760 is show axially central to male contact plate 720.

Male collar 708 is suited to receive male contact plate 720 interior to skirt first section 731, skirt second section 732 and skirt third section 733. Male grommet 750 can comprise several openings. Male grommet first guide 751 can retain first male conduit 701, male grommet second guide 752 can retain second male conduit 702, and male grommet third guide 753 can retain third male conduit 703. First male auxiliary guide 754, second male auxiliary guide 755, and third male auxiliary guide 756 can accommodate passage of auxiliary signal wires, not shown, as needed. Male collar 708 can be removably attached to male back shell 705 with conventional threaded fasteners, not shown, to prevent rotation of male collar 708 relative to male back shell 705.

Figure 6D:
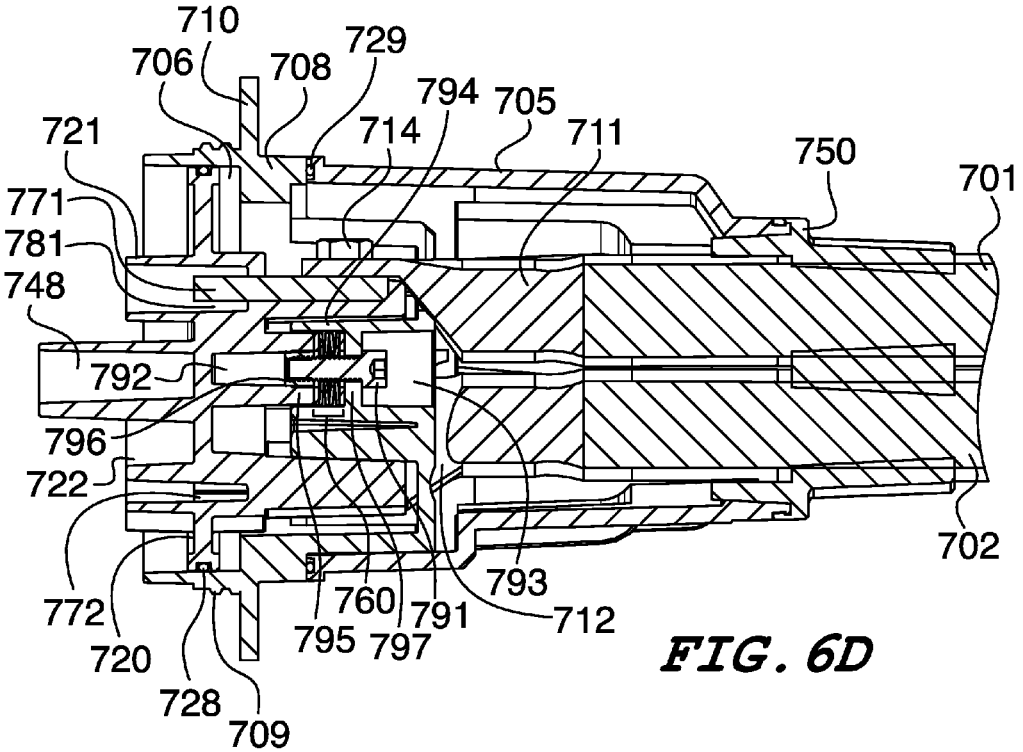
FIG. 6D presents a sectional view of a male side of an in-line connector in an embodiment of the invention.

FIG. 6D presents a sectional view of a male side of an inline connector in an embodiment of the invention. Male contact plate 720 is shown interior to male collar 708. Contact O-ring 728 interfaces with male collar 708 and provides for smooth sliding and sealing. Compression gap 706 is shown between male contact plate 720 and male collar 708. This space allows contact plate 720 to move to the right of the figure and closer to central sleeve 794. Central sleeve 794 can be formed as part of male collar 708 and made of molded plastic or similar materials. Central sleeve 794 is fixed in position relative to male collar 708. Central sleeve 794 can comprise central seat 797 and fixed recess 793. Fixed recess 793 allows access to retention fastener 791 while central seat 797 provides a restriction of central sleeve 794 whereby retention fastener 791 can connect and retain central sleeve 794 to threaded insert 796. Threaded insert 796 is fixed within central piston 795. When assembled, retention fastener 791 is fixed relative to threaded insert 796 and pressing against central seat 797 and maintaining a maximum relative distance between male contact plate 720 and male collar 708. Central piston 795 can be formed as part of male contact plate 720 and has a fixed position relative the other elements formed on male contact plate 720 such as, for example, alignment key 748 and first male finger guard 721. Movement of male contact plate 720 through compression gap 706 towards male collar 708 has the effect of pushing central piston 795 toward compressible stack 760. Further movement fully compresses compressible stack 760 and provides for a high force connection as shown in the following drawings.

Figure 7A:
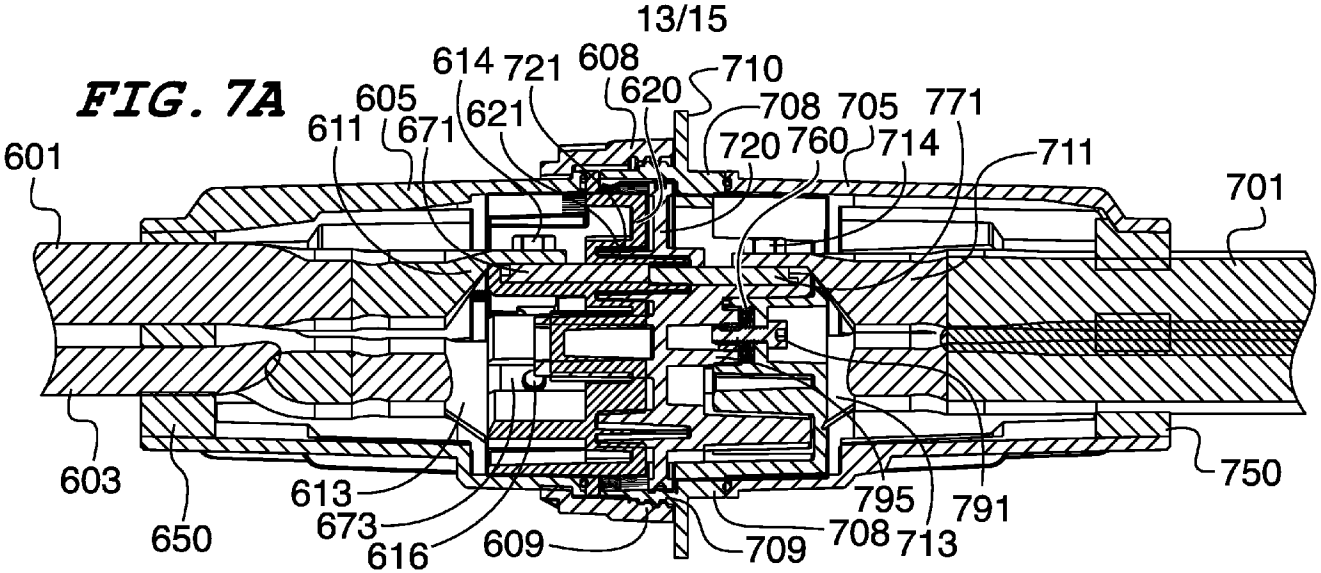
FIG. 7A presents a sectional view of an inline connector in an embodiment of the invention.

FIG. 7A presents a sectional view of an inline connector comprising a male side and a female side in an embodiment of the invention. Female back shell 605 is shown interior to female collar 608. Male collar 708 is threadedly connected to female collar 608. Rotation of female collar 608 causes male collar 708 and female collar to be drawn together as interior threads 609 engage exterior threads 709. Female contact plate 620 is forced towards male contact plate 720 and compressible stack 760 is contacted and compressed by central piston 795 as female collar 608 is turned. Force is built up as the compressible stack 760 is compressed. In one embodiment of the invention interior threads 609 and exterior threads 709 can have a pitch of 0.2 inches per rotation. Rotation of female collar 608 through approximately 72 degrees can provide compression of 0.04 inches to compressible stack 760. This can produce a force of 400 pounds to provide a high force, low resistance electrical connection that can be easily connect, or disconnected, by hand. Compressible stack 760 can comprise one compressible element or as many as eight or more as is needed in a particular application. It has been found that the majority of the resistance reduction in a surface contact can be achieved by providing a force of 400 pounds. It has also been found that a Belleville washer having a radius of 0.75 inches and a thickness of 0.028 inches can compress 0.01 inches, and that a series of four compressible washers can be compressed 0.04 inches in total to provide a 400 pound force connection. It will be understood that similar compressible stacks comprising more or less elements will provide for more compression and require and provide more force.

Figure 7B:
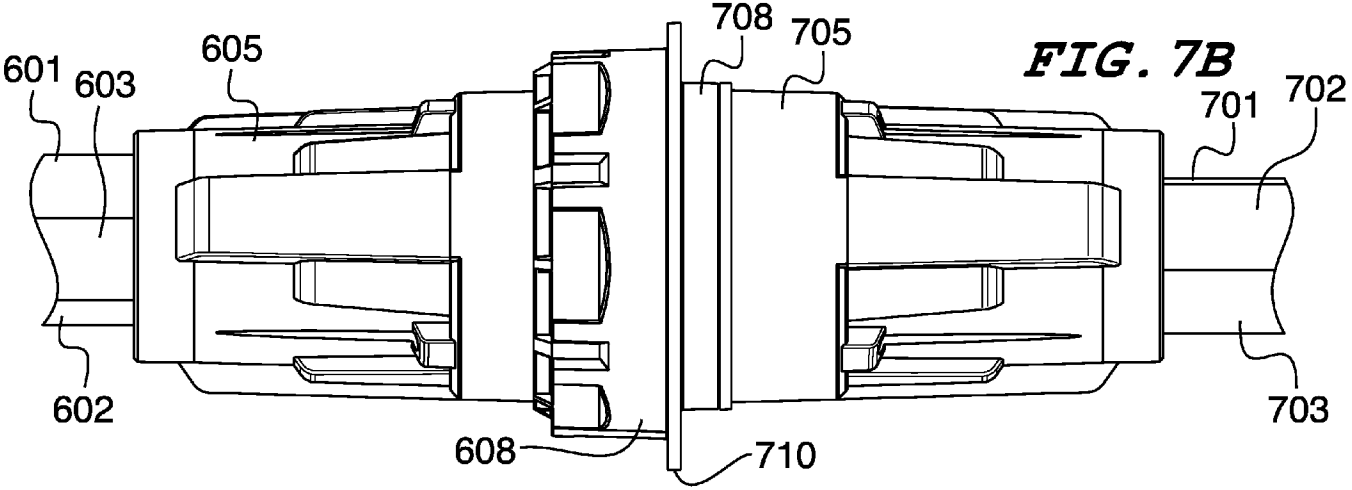
FIG. 7B presents a side view of an inline connector in an embodiment of the invention.

FIG. 7B presents a side view of an inline connector comprising a male side and a female side in an embodiment of the invention. Female collar 608 is shown connected to male collar 708.

Figure 7C:
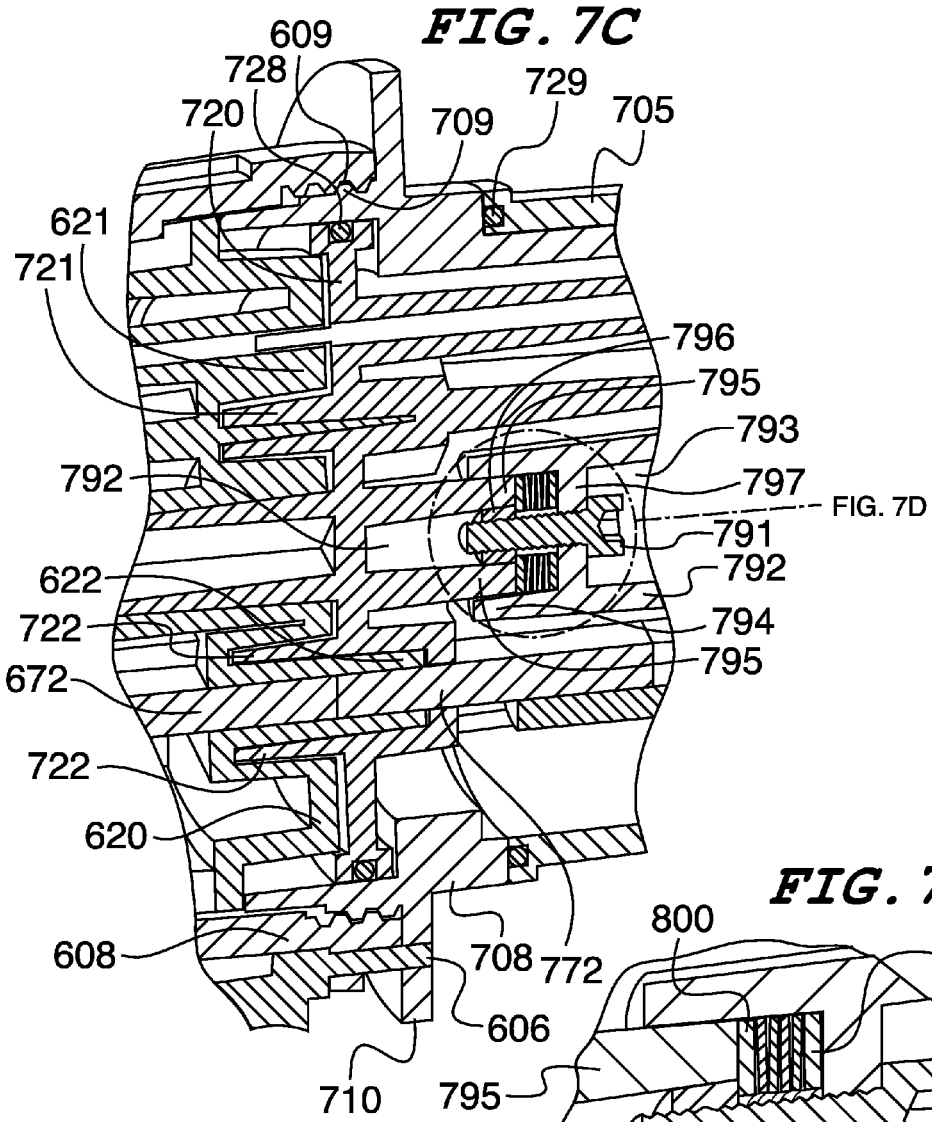
FIG. 7C presents a close up of a sectional view of an inline connector in an embodiment of the invention.

FIG. 7C presents a close up of a sectional view of male and female sides of an inline connector in an embodiment of the invention. In this view, female collar 608 has been rotated to compress compressible stack 760 between central piston 795 and central seat 797. Compressible stack 760 can be comprised of a number of compressible and incompressible elements. As the female collar 608 is rotated onto male collar 708, female contact plate 620 and male contact plate 720 are forced together. The presence of compressible stack 760 between male contact plate 720 (which comprises central piston 795) and male collar 708 (which comprises central sleeve 794 and central seat 797) allows the female collar to be rotated and the force of the connection to be generated over a longer distance determined by the pitch of interior threads 609, and exterior threads 709. Second female finger guard 622 telescopes with second male finger guard 722. Second female contact 672 and second male contact 772 are pressed together to create a high force connection. The use of a compressible stack 760 allows the force to be generated over a sufficient distance to allow the device of the invention to be operated by hand. The two other sets of male and female contacts, not shown in this figure, are similarly positioned and similarly connected. Not shown in this figure, first female contact 671 and first male contact 771 are pressed together to create a high force connection. Also not shown in this figure, third female contact 673 and third male contact 773 are pressed together to create a high force connection. Compressible stack 760 reduces the sensitivity of the assembly to tolerances, by providing spring travel equal to the cumulative compression of the elements in compressible stack 760. Compressible stack 760 can provide a very high spring rate on the order of 10,000 lb/in. Locking tab 606 is shown engaged with flange 710. Contact O-ring 728 helps seal male contact plate 720 to male collar 708. Shell O-ring 729 helps seal male collar 708 to male back shell 705.

Figure 7D:
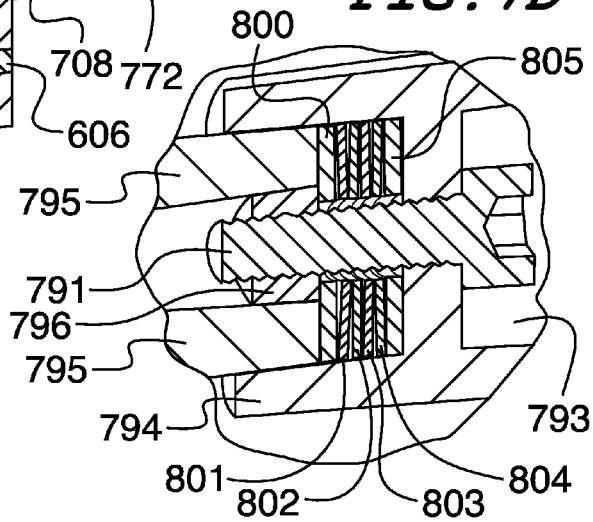
FIG. 7D presents a further close up of a sectional view of an inline connector in an embodiment of the invention.

FIG. 7D presents a further close up of a sectional view of an inline connector in an embodiment of the invention. For stability, it is useful to place a solid, non-deforming element on each end of the stack, such as a stack washer. A non-deforming element does not mar a plastic surface as it does not change configuration. For effectiveness, it is needed to provide a compressible element, or a plurality of compressible elements and these can preferably be placed between the non-deforming elements. Although a number of materials and configurations will function as a compressible element, it has been found that one suitable arrangement is to provide a series of four conical washers to provide for compression of the compressible stack. In order to provide for compression over a longer area, the conical washers can be placed with convex sides facing and or touching. In this way, the range of compression is maximized. As to the particular embodiment shown here, compressible stack 760 of FIG. 7A is shown with its component parts. First stack washer 800, a first conical washer 801, a second conical washer 802, a third conical washer 803, a fourth conical washer 804, and a second stack washer 805 are positioned adjacent each other and aligned to fit within central sleeve 794. Conical washers can also be called spring washers or Belleville washers. Central piston 795 is slidable within central sleeve 794 and contacts first stack washer 800. Second stack washer 805 is retained within central sleeve by central seat 797. Elements 800, 801, 802, 803, 804, and 805 are retained between threaded insert 796 and central seat 797. Retention fastener 791 maintains axial alignment of 800, 801, 802, 803, 804, and 805 within central sleeve 794.

Figure 8A:
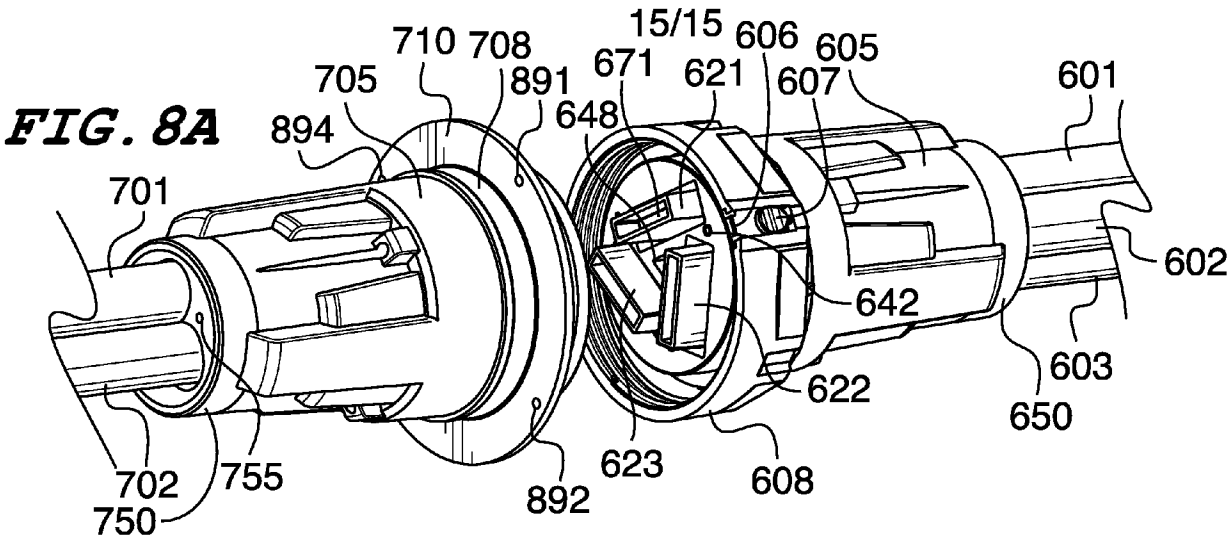
FIG. 8A presents a perspective view of an inline connector in an embodiment of the invention.

FIG. 8A presents a perspective view of the male and female sides of an inline connector in an embodiment of the invention. In this view, the finger guards of the female side are viewable. First female contact 671 is viewable inside first female finger guard 621.

Figure 8B:
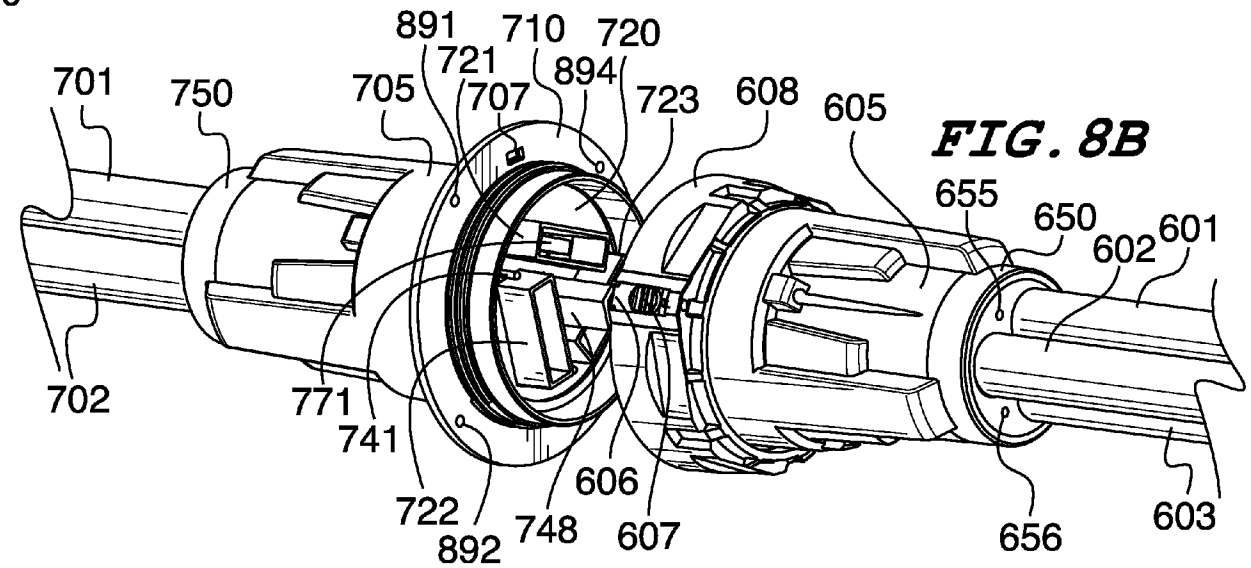
FIG. 8B presents a perspective view of an inline connector in an embodiment of the invention.

FIG. 8B presents a perspective view of the male and female sides of an inline connector in an embodiment of the invention. In this view, the finger guards of the male side are viewable. First male contact 771 is viewable inside first male finger guard 721. FIGS. 8A and 8B combine to show the orientation of the various elements of male contact plate 720 and female contact plate 620 and how they are oriented when connected.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An electrical switch, comprising:

a rotary handle and a lead screw attached to said rotary handle and configured to rotate with rotation of said rotary handle;

a compressible stack comprising a plurality of separable elements positioned within a cylindrical recess of a seat, said seat configured to retain a conductive element and prevent rotation of said conductive element;

a first post, a second post, and a spring positioned to bias said conductive element away from said first post and said second post; and turning said rotary handle in a first direction engages said lead screw against a lead nut and effects movement of said lead screw relative said lead nut and towards said seat to compress said compressible stack and force said conductive element to overcome said spring and contact said first post and said second post to make a high force conductive connection.

2. The switch of claim 1 wherein movement of said rotary handle in a second direction effects movement of said lead screw against said lead nut to move said lead screw away from said seat and disconnect said conductive element from said first post and said second post to prevent the flow of current between said first post and said second post.

3. The switch of claim 2 further comprising:

a switch housing connected to an assembly cap wherein said first post and said second post are fixedly connected to said switch housing:

said lead nut is fixedly connected to said assembly cap and said lead nut comprises a fixed thread that engages a lead thread disposed on said lead screw; and turning said rotary handle causes said lead screw and said rotary handle to move along an axis of rotation of said rotary handle wherein said fixed thread and said lead nut remain stationary.

4. The switch of claim 3 further comprising a bezel surrounding said rotary handle and comprising a bezel key hole spaced apart from an axis of rotation of said rotary handle, said bezel threadedly connected to an L shaped mounting bracket for mounting said switch to a surface, and said assembly cap, wherein said assembly cap further comprises a switch locator key protruding from the surface of said assembly cap and spaced apart from said axis of rotation to engage said bezel key hole to establish rotational alignment of said assembly cap and said bezel and prevent rotation of said bezel relative said assembly cap, and rotation of said lead screw in a first directions moves said rotary handle axially towards said bezel.

5. The switch of claim 1 wherein said compressible stack comprises at least one conical washer that can be compressed about 0.01 inches and transmits 100 pounds of force.

6. The switch of claim 1 wherein said compressible stack comprises a first stack washer, a first conical washer, a second conical washer, a third conical washer, a fourth conical washer, and a second stack washer, and said compressible stack can be compressed about 0.04 inches and requires a force of about 400 pounds.

7. The switch of claim 6 wherein said first conical washer convex side contacts said second conical washer convex side and said third conical washer convex side contacts said fourth conical washer convex side to provide compression of at least 0.036 inches.

8. The switch of claim 4 wherein said lead thread has a pitch of 0.4 inches per revolution and rotation of rotary handle through one quarter turn provides movement of said lead screw of approximately 0.1 inches to compress said compressible stack and move said conductive element to contact said first post and said second post.

9. A rotary switch comprising:

a rotary handle comprising a paddle;

a bezel comprising an activation switch further comprising a plunger configured to be activated by said paddle to cause a signal to be transmitted from a first lead wire to a signal wire;

a lead screw connected to said rotary handle, said lead screw comprising a lead thread configured to engage a fixed thread of a fixed nut fixedly connected to an assembly cap, said assembly cap threadedly connect to said bezel; and a switch housing removably connected to said assembly cap, said switch housing comprising a first post and a second post and containing a bus bar retained within a seat, said seat further comprising a recess containing a compressible stack positioned axially central to said lead screw wherein rotation of said rotary handle causes said lead screw to compress said compressible stack, and transmit a force to said bus bar to overcome a spring and contact said first post and said second post to form a low resistance connection, wherein said paddle is configured to depress said plunger after said bus bar contacts said first post and said second post.

10. The rotary switch of claim 9 wherein said rotary handle comprises a radial protrusion, said bezel comprises a first stop and a second stop, and said first stop comprises a stop hole for attaching said radial protrusion to said first stop to prevent rotation of said rotary handle.

* * * * *